United States Patent [19]

FitzSimons

[11] Patent Number: 4,558,969

[45] Date of Patent: Dec. 17, 1985

[54] HINGE FOR USE WITH LARGE PRE-CAST OVERFILLED LOAD SUPPORT STRUCTURES

[75] Inventor: Louis N. FitzSimons, Kensington, Md.

[73] Assignee: Bebo of America, Kensington, Md.

[21] Appl. No.: 590,804

[22] Filed: Mar. 19, 1984

[51] Int. Cl.[4] ..... E01F 5/00

[52] U.S. Cl. ..... 405/124; 52/86; 52/89; 405/151

[58] Field of Search ..... 405/124, 125, 126, 127; 52/86–89

[56] References Cited

U.S. PATENT DOCUMENTS

| | | | |
|---|---|---|---|
| 862,292 | 8/1907 | Stoffer . | |
| 886,666 | 5/1908 | Thomas | 52/89 |
| 1,329,643 | 2/1920 | Thomas . | |
| 1,784,271 | 12/1930 | Collins | 405/124 |
| 1,849,558 | 3/1932 | Thursby | 52/89 |
| 2,126,091 | 8/1938 | Claybaugh . | |
| 2,161,177 | 6/1939 | Leisner . | |
| 2,298,184 | 10/1942 | Von Rosenberg . | |
| 2,812,730 | 11/1957 | Hermann | 52/86 |
| 3,276,171 | 10/1966 | Brown | 52/86 |
| 3,282,056 | 11/1966 | Fisher . | |
| 3,304,954 | 2/1967 | Kaiser . | |
| 3,343,320 | 9/1967 | Krajcinovic . | |
| 3,508,406 | 4/1970 | Fisher . | |
| 3,748,796 | 7/1973 | Ovellet | 52/86 |
| 4,010,617 | 3/1977 | Fisher . | |
| 4,390,306 | 6/1983 | Fisher . | |

FOREIGN PATENT DOCUMENTS

| | | | |
|---|---|---|---|
| 935451 | 2/1948 | France | 405/126 |
| 641535 | 8/1950 | United Kingdom | 52/89 |

*Primary Examiner*—Dennis L. Taylor

*Attorney, Agent, or Firm*—Terry M. Gernstein

[57] ABSTRACT

Arch elements (S) of an overfilled load support structure (L) suitable for use in highway construction are associated with a foundation (F) by a hinge (10). The hinge is formed by edges (12,14) of the arch element bearing on a horizontally disposed load bearing surface (22) and a vertically disposed load bearing surface (24). Essentially unrestrained rotation about the edge bearing on the horizontally disposed surface is permitted, and translation of the element is primarily restrained by the edge bearing against the vertically disposed load bearing surface. The rest of the element is spaced from the foundation.

11 Claims, 3 Drawing Figures

HINGE FOR USE WITH LARGE PRE-CAST OVERFILLED LOAD SUPPORT STRUCTURES

DESCRIPTION

1. Technical Field

The present invention relates in general to large overfilled load support structures used in highway bridges, or the like and more particularly to hinges for use with such structures.

2. Background Art

In a two-hinge overfilled load support structure, a hinge associates the base of an arch element, or other such load support structure element with a foundation. It is the function of these hinges to transmit thrust to the foundation without endangering the structure. Thus, an ideal hinge restrains translation of the structural element, yet permits essentially unrestrained rotation of the structural element about the end of the load support structure element.

Hinges in highway bridges and other such large structures are subject to extremely high forces and fatigue caused by load repetition. The extremely high stress concentrations combined with the fatigue factors and the requirement that the hinge permit essentially unrestrained rotation have placed strict limitations on the design of the hinges.

Steel hinges such as disclosed in U.S. Pat. No. 1,329,643, are generally formed of special metal shoes fixed to the elements on either side of the hinge and then pinned together, and are capable of withstanding stresses and fatigues. However, steel hinges, which are also known as external hinges, can be extremely expensive and difficult to install.

Concrete alone, although generally less expensive to use in hinge applications than steel, can not withstand the stress and fatigue incident to such hinges. Thus, it has been the practice of engineers and designers to reinforce a concrete hinge with steel bars. These types of hinges are also known a internal hinges, and examples of such internal hinges are the Mesnager hinge and the Considere hinge.

The reinforcing bars in these prior art hinges extend from the support structure element through the hinge and into the foundation to allow the hinge to accomodate rotation. However, this configuration of reinforcing bars is expensive and makes pre-casting of the load support structure element virtually impossible. Furthermore, hinges using such reinforcing bars are partially restrained against rotation thereby creating inaccuracies in design calculations. These inaccuracies are usually accounted for by safety factors which are generated by experience and often published as ranges of dimensions which are acceptable for use in defined circumstances. However, use of safety factors requires extra materials, the cost of which may militate against the savings realized by replacing a steel hinge with a reinforced concrete hinge.

Accordingly, because of the high stress concentrations and fatigue experienced by hinges in large structures such as highway bridges, or the like, as well as the requirement that the hinge permit rotation while restraining translation, prior art hinges have either been expensive external hinges formed entirely of steel, or internal hinges formed of concrete which is reinforced in the manner of the Mesnager and Considere hinges which are virtually impossible to pre-cast and which still may be expensive.

DISCLOSURE OF THE INVENTION

It is a main object of the present invention to provide a novel hinge for use with large overfilled pre-cast load support structures which is inexpensive and easy to construct, yet which adequately accomodates stress concentrations and fatigue incident to such structures.

It is another object of the present invention to provide a novel hinge for use with large overfilled pre-cast load support structures which eliminates a need for either an external hinge or an internal hinge. It is another object of the present invention to provide a novel hinge for use on large overfilled pre-cast load support structures which can be pre-cast rapidly and expeditiously.

It is another object of the present invention to provide a novel method of forming a hinge for use with large pre-cast overfilled load support structures.

It is another object of the present invention to provide a pre-cast hinge for use with large overfilled pre-cast load support structures which restrains translation of a support structure element but permits essentially unrestrained rotation of that element.

These and other objects are accomplished by a hinge which is formed entirely by a foundation and two edges of a pre-cast load support structure element, and a method for forming such a hinge. The load support structure element includes a bottom which intersects an inner surface of the element to form an inner edge and intersects the outer surface of the element to form an outer edge. The load support structure element contacts the foundation only at these two edges, with a first edge abutting a vertically oriented surface in a keyway defined in the foundation to be the primary means for restraining translation of the structure element, and a second edge bearing on a horizontally oriented surface in the keyway and forming an axis of rotation about which the load support structure element freely rotates. The second edge also contributes to the restraint of element translation. The remainder of the load support structure element is spaced from keyway surfaces. Translation of the element is thus restrained, yet free rotation of the element is permitted by a hinge which is inexpensive and easy to form as compared to prior art hinges, especially steel external hinges, yet which is not subject to the drawbacks of internal hinges. The foundation is formed of reinforced concrete, and the reinforcing bars used in the foundation are close enough together for ample strength, yet, are far enough apart to be economical.

It is a more specific object to the present invention to provide a novel hinge for use with large overfilled pre-cast load support structures wherein the load support structure element is preferably an arch of pre-cast reinforced concrete similar to the arch disclosed in U.S. Pat. No. 3,482,406 and can be an nth degree arch, having a span of up to about forty-one feet, and a span/rise ratio of up to about 4:1. The foundation reinforcing bars preferably have a center-to-center spacing of less than twelve inches, and the load support structure element also includes reinforcing bars which preferably have a center-to-center spacing of less than about six inches. The keyway can include a leveling block on the horizontally oriented load bearing surface thereof as well as a filler block interposed between the translation preventing support structure edge and the vertically oriented load support surface in the keyway. Grout-like material can be located in the keyway.

BEST MODE FOR CARRYING OUT THE INVENTION

Figure 1:
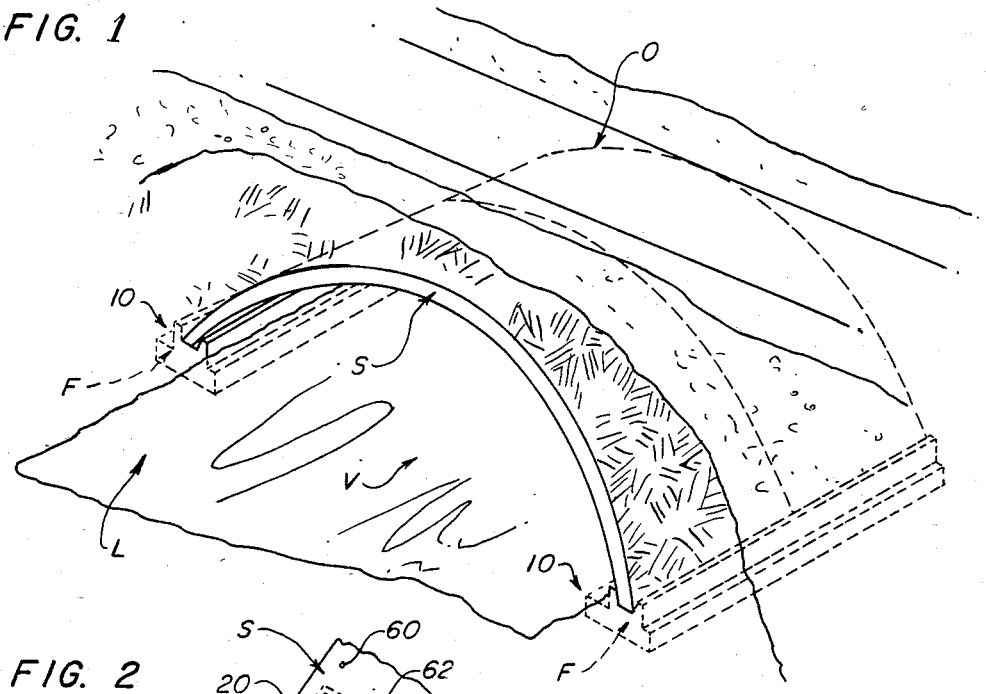
FIG. 1 is a perspective of an overfilled load support structure using a hinge embodying the present invention.

Shown in FIG. 1 is a large overfilled load support structure L for supporting an overpass O, such as a bridge, a highway, or the like, over an underpass U, such as another highway, or the like. The load support structure L comprises a plurality of pre-cast concrete load support elements, such as arches S mounted on foundations F, with each of the arches having a width dimension extending along the underpass and a length or span dimension extending across the underpass.

Figure 2:
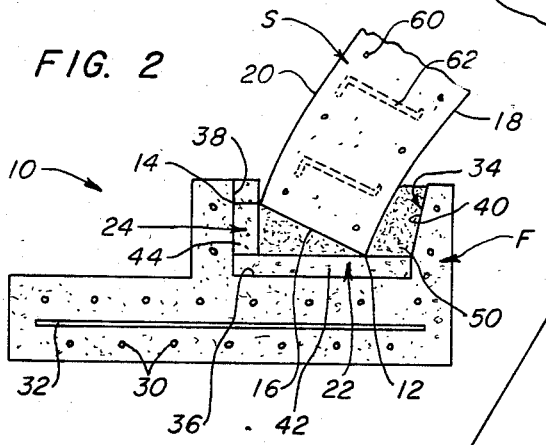
FIG. 2 is a view taken along 2—2 of FIG. 1.

Each arch is associated with the foundations F by a hinge 10. As best shown in FIG. 2, a hinge 10 is formed entirely and exclusively by edges 12 and 14 of the arch which are defined by the intersection of arch bottom end 16 with arch inner surface 18 and outer surface 20 bearing on a horizontally disposed load bearing means 22 which bears vertically directed forces, and a vertically disposed load bearing means 24 which bears horizontally directed forces. Both load bearing means are located in the foundation for ease of construction.

The arch S is oriented so that arch bottom 16 is spaced from the foundation everywhere except at edges 12 and 14 thereby permitting essentially unrestrained rotation about edge 12 so that an ideal hinge can be approached. The abutment between edge 14 and vertically disposed load bearing means 24 is the primary means for restraining translation of the arch tending to increase the span of that arch. However, the frictional forces generated at the abutment between edge 12 and horizontally disposed load bearing means 22 also contributes to restraining the translation of the arch.

The foundations are formed of concrete which includes steel reinforcing bars 30 and 32 spaced so that cracks in the foundation do not enlarge to a size which may cause the foundation to fail. However, reinforcing bars 30 and 32 are also spaced apart far enough to make the hinge 10 economically possible. Therefore, for a foundation used in a highway-type application, the spacing between reinforcing bars 30 and between bars 32 is less than about twelve inches, and preferably is in a range of about two to twelve inches.

As shown in FIG. 2, a keyway 34 is defined in the foundation to have a bottom 36 and sides 38 and 40. A horizontal leveling block 42 rests on the bottom 36 and is interposed between the arch element and the keyway bottom. This leveling block can be a shim block, or the like, and serves to level the arch element and also to distribute the weight of the arch element over the area of the keyway bottom. A vertically disposed filler block 44 is interposed between the arch element and keyway side 38 to distribute forces caused by translation-inducing forces on the arch element. Grout-like material 50 can be located in keyway 34 to add some support to the arch S and also to prevent infiltration into the area adjacent to edges 12 and 14 of the arch.

The load support structure arch element is formed of pre-cast concrete which is reinforced by a plurality of reinforcing bars 60 and 62. The reinforcing bars 60 and 62 are spaced close enough together to prevent cracks in the arch element from causing a failure, yet are far enough apart to be economically practical. These bars therefore are spaced apart less than about six inches in arches used in highway applications. Preferably, the bars 60 and the bars 62 are spaced apart a distance which is in the range of between about one inch and six inches.

Figure 3:
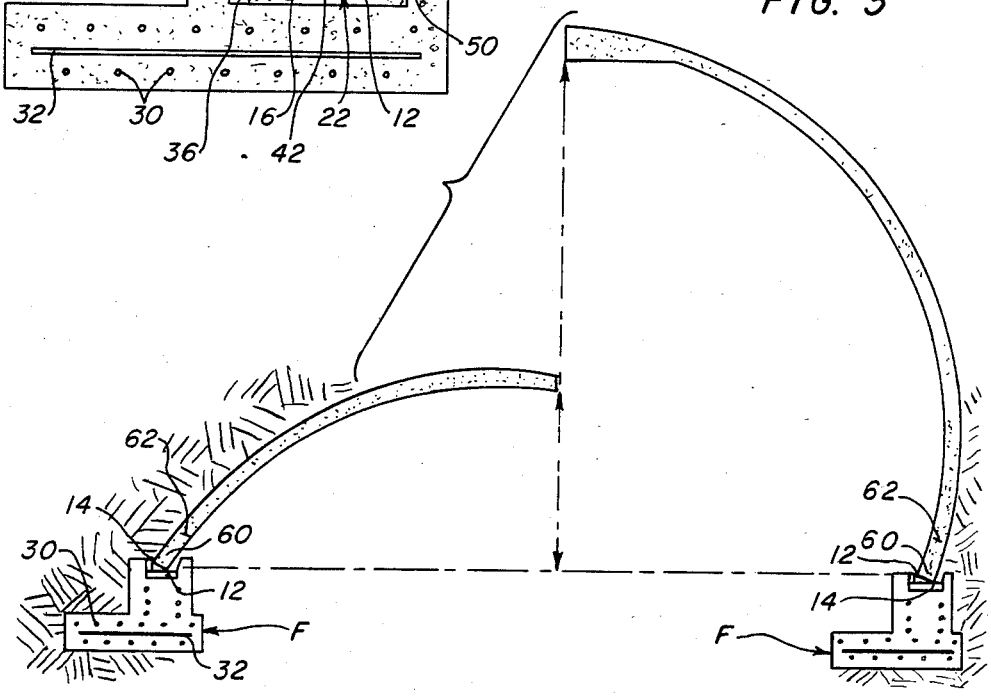
FIG. 3 is an elevation view showing various configurations of a load support structure element and hinges in accordance with the teaching of the present disclosure.

As indicated in FIG. 3, depending on the shape and size of the arch element, either the arch inner edge 12 or the arch outer edge 14 can be the rotational axis forming edge, (with the inner edge 12 being the rotational axis forming edge in FIG. 2) and either edge can be the primary translation restraining edge, (with the outer edge 14 being the primary translation restraining edge in FIG. 2).

Hinge 10 can be easily and quickly formed during erection of the load support structure as no special connections need be formed and made, and no special positioning of the load support structure arch elements is required. The hinge adequately accomodates stress concentration along the line of bearing and will not fail due to load repetition induced fatique which is especially important in highway applications.

The hinge shown in FIG. 2 is formed by constructing the foundations, which can be pre-cast or cast-in-place to have keyways 34 properly located to receive the ends of the arch S. A leveling course is formed in the keyway and will include leveling blocks on the bottom of the keyway and can include grout-like material. Vertically oriented filler blocks are also placed in the keyway. Once the leveling course is leveled and sized as required, the arches are placed in the keyway to have one edge bearing on the horizontally disposed surface in the keyway and one edge abutting a vertically disposed surface in the keyway, and the remainder of the arch spaced from the surfaces in the keyway. Once the arch is properly positioned, grout-like material is used to fill that keyway to the desired level.

INDUSTRIAL APPLICABILITY

The hinge 10 is most useful with a load support structure using arch-shaped elements formed in accordance with the teachings of U.S. Pat. No. 3,482,406 and guidelines and specifications used by BEBO of America of Kensington, Md. or BEBO International-Heierle & Co. of Zurich, Switzerland. The hinge can be used with such arches having any reasonable shape of the nth degree. Overfill depths of up to ten feet have been tested, but studies indicate just about any overfill depth could be used due to a natural arching effect. The method of forming the hinge disclosed herein can also be varied without departing from the scope of this disclosure. As a specific example, a hinge 10 was used to associate an arch element having a length of 41′, a rise of $9\frac{3}{4}$″, with a thickness of 10″, and #6 reinforcing bars of the type 60 on a center-to-center spacing of 3″, with a foundation. The foundation was formed of 3000 psi concrete having #4 steel reinforcing bars therein on a center-to-center spacing of 6″. The dimensions of the foundation were as follows: height 2′, width 6′, keyway bottom 14″ above the bottom of the foundation. The horizontally disposed leveling pad was 2″ bed of grout and the vertically disposed filler block was solid 4″×8″×16″ cmu. The keyway contained 3000 psi grout. The overfill used with this hinge had a unit weight of 120 pof and a depth of 3".

I claim:

1. A hinge for use with large pre-cast overfilled load support structures such as are used in highway construction or the like for associating an element of the structure with a foundation, wherein the element includes a bottom end intersecting an inner surface of the element to form an inner edge and intersecting an outer surface of the element to form an outer edge, comprising:

a first means for bearing vertically directed forces on the foundation;

a second means for bearing horizontally directed forces on the foundation;

rotational axis forming means for permitting essentially unrestrained rotation of the element, said rotational axis forming means consisting entirely of one of the element edges bearing on said first means; and restraining means for restraining translation of the element tending to increase the span, said restraining means including the outer edge of element bearing against said second means.

2. The hinge defined in claim 1 wherein the element bottom end is spaced from both said first and second means everywhere except at said edges.

3. The hinge defined in claim 2 wherein said restraining means further includes the element one edge with the element other edge being the primary means for restraining translation.

4. The hinge defined in claim 3 further including reinforcing bars in the foundation and in the load support structue element.

5. The hinge defined in claim 4 wherein the reinforcing bars in the foundation have a center-to-center spacing of less than about twelve inches and the reinforcing bars in the load support structure element have a center-to-center spacing of less than about six inches.

6. The hinge defined in claim 5 wherein the load support structure is an nth degree arch element.

7. The hinge defined in claim 3 wherein the first and second means each includes a filler block.

8. The hinge defined in claim 2 further including a keyway defined in the foundation and having first means located therein.

9. The hinge defined in claim 2 further including a keyway defined in the foundation and having said second means located therein.

10. The hinge defined in claim 6 wherein said arch element has a span of about forty-one feet and a span/-rise ratio of less than about 4:1.

11. The hinge defined in claim 2 wherein the overfill is about ten feet in depth.

* * * * *